US007287601B2

(12) United States Patent
Hellbach et al.

(10) Patent No.: US 7,287,601 B2
(45) Date of Patent: Oct. 30, 2007

(54) POWER TOOL WITH A ROTATING AND/OR HAMMERING DRIVE MECHANISM

(75) Inventors: Manfred Hellbach, Leinfelden-Echterdingen (DE); Frank Mueller, Deckenpfronn (DE); Gerhard Meixner, Filderstadt (DE); Hubert Steinke, Leinfelden-Echterdingen (DE); Juergen Lennartz, Ostfildern (DE)

(73) Assignee: Robert Bosch GmbH, Stuttgart (DE)

( * ) Notice: Subject to any disclaimer, the term of this patent is extended or adjusted under 35 U.S.C. 154(b) by 102 days.

(21) Appl. No.: 11/108,952

(22) Filed: Apr. 19, 2005

(65) Prior Publication Data

US 2005/0247464 A1 Nov. 10, 2005

(30) Foreign Application Priority Data

Apr. 23, 2004 (DE) ..... 10 2004 019 776

(51) Int. Cl.
*B25D 17/04* (2006.01)

(52) U.S. Cl. ..... 173/162.2; 173/162.1; 173/170; 16/431; 16/110.1

(58) Field of Classification Search ..... 173/162.1, 173/162.2, 170; 16/431, 405, 430, 443, 110.1
See application file for complete search history.

(56) References Cited

U.S. PATENT DOCUMENTS

| | | | | |
|---|---|---|---|---|
| 1,573,458 | A * | 2/1926 | Smith | 173/162.2 |
| 1,711,688 | A * | 5/1929 | O'Farrell | 173/162.2 |
| 4,282,938 | A * | 8/1981 | Minamidate | 173/162.2 |
| 4,478,293 | A * | 10/1984 | Weilenmann et al. | 173/162.2 |
| 4,673,043 | A * | 6/1987 | Greppmair | 173/162.2 |
| 4,711,308 | A * | 12/1987 | Blaas et al. | 173/162.2 |
| 5,025,870 | A | 6/1991 | Gantner | |
| 5,269,381 | A * | 12/1993 | Oscarsson | 173/162.2 |
| 5,697,456 | A * | 12/1997 | Radle et al. | 173/162.2 |
| 6,076,616 | A * | 6/2000 | Kramp et al. | 173/162.2 |
| 6,148,930 | A * | 11/2000 | Berger et al. | 173/162.2 |
| 7,076,838 | B2 * | 7/2006 | Meixner | 16/431 |
| 7,100,706 | B2 * | 9/2006 | Meixner et al. | 173/162.2 |
| 2003/0132016 | A1 | 7/2003 | Meixner et al. | |
| 2004/0040729 | A1 | 3/2004 | Meixner | |

FOREIGN PATENT DOCUMENTS

| | | |
|---|---|---|
| DE | 41 24 574 A1 | 1/1993 |
| EP | 1 221 359 A1 | 7/2002 |
| GB | 1 171 045 A | 8/1986 |
| GB | 2 297 514 A | 8/1996 |

* cited by examiner

*Primary Examiner*—Scott A. Smith
(74) *Attorney, Agent, or Firm*—Michael J. Striker

(57) ABSTRACT

A hand-operated power tool has a housing with a drive mechanism for driving a tool, a tool receptacle for receiving a tool, a handle assembly for grasping and handling located in a rear region which is remote from the tool receptacle and engaging the housing, wherein the handle assembly is vibration-damped with respect to the housing with components contained in the housing, at least and substantially in an axial direction.

15 Claims, 2 Drawing Sheets

POWER TOOL WITH A ROTATING AND/OR HAMMERING DRIVE MECHANISM

BACKGROUND OF THE INVENTION

The invention is based on a hand-operated power tool, in particular a drill hammer and/or jackhammer.

In hand-operated power tools of this kind, vibrations occur upon use, particularly in the hammering mode, that make the work more difficult. Attempts have been made to reduce such vibration by means of such devices as complex systems of double-shell construction, or with parallel oscillators. Such systems are very expensive and make a large structural volume necessary.

SUMMARY OF THE INVENTION

The hand-operated power tool of the invention has the advantage over the prior art of simple disposition, low cost and a small structural volume, and at the same time it is not vulnerable to external mechanical impairments, dirt, or the like.

By the provisions recited in the further claims, advantageous refinements of and improvements to the hand-operated power tool defined by claim 1 are possible. With the characteristics of claim 2, with a simple arrangement, vibration damping of the entire handle assembly is obtained; the handle assembly can yield inward at least and essentially in the axial direction relative to the rest of the hand-operated power tool, with simultaneously reliable guidance transversely thereto, regardless of how the user is handling the tool. The design of claim 12 and of claims 13 through 15 is especially advantageous. As a result, highly effective vibration damping is attained with simple, economical means and with a small structural volume.

The invention is described in further detail below in terms of an exemplary embodiment shown in the drawing.

DETAILED DESCRIPTION OF THE PREFERRED EMBODIMENTS

Figure 1:
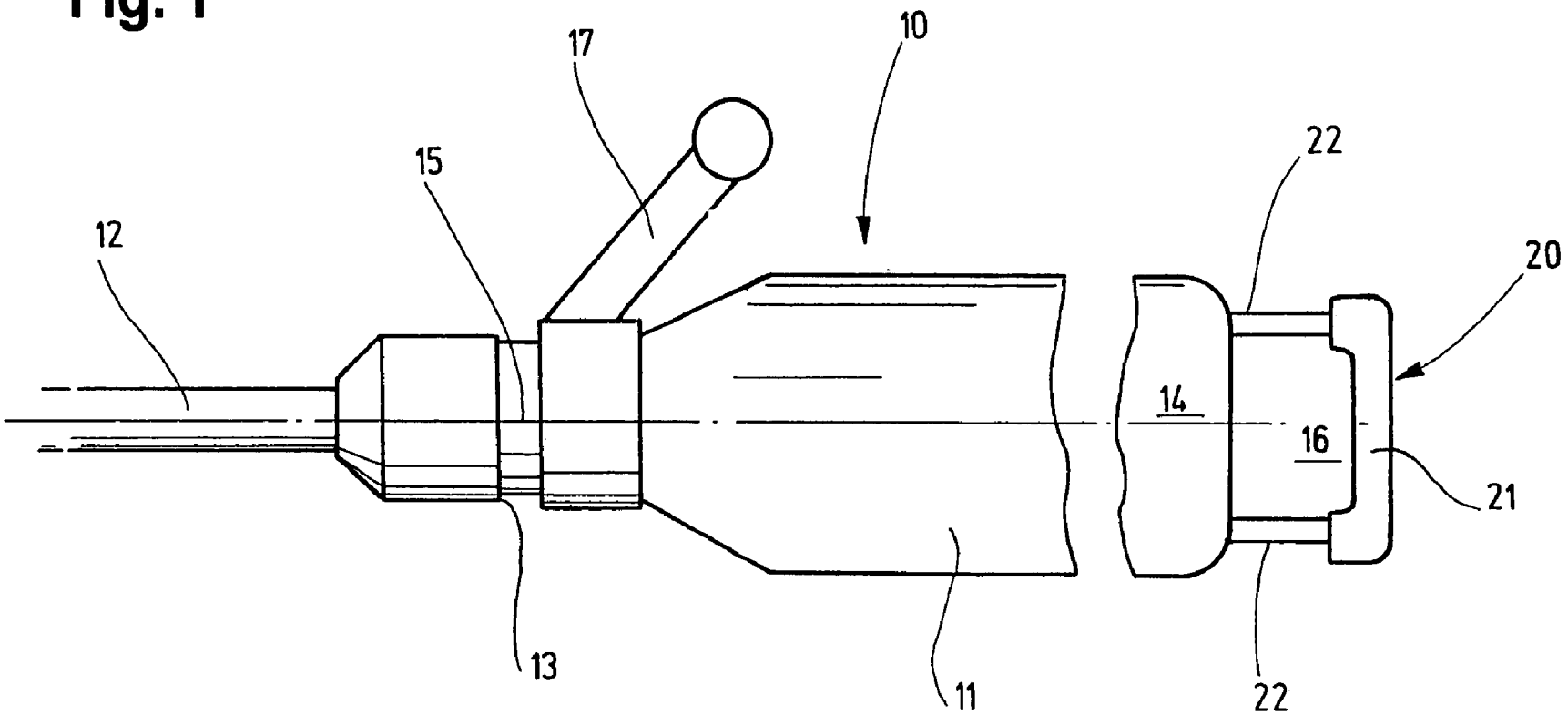
FIG. 1 is a simplified schematic side view of a hand-operated power tool.

In FIG. 1, a hand-operated power tool 10, particularly in the form of a drill hammer and/or jackhammer, for example, is shown schematically. This may be a jackhammer (pavement-breaking hammer), with a weight of 14 kg or more, for instance. Instead, it may be a drill hammer and/or jackhammer which alternatively makes drilling operation with hammering operation possible, or only drilling operation, or only hammering operation.

The hand-operated power tool 10 has a housing generally identified by reference numeral 11. In its interior, this housing contains a conventional drive mechanism, not further shown, such as an electric drive motor, which operates via a gear on a downstream drilling and/or hammering mechanism. The drive mechanism serves to drive a tool 12, represented only schematically, which is received interchangeably in the usual way in a tool receptacle 13. In the rear region 14, remote from the tool receptacle 13, there is a handle assembly 20, for grasping and manipulating the hand-operated power tool 10, that engages the housing 11. The handle assembly has a handle 21, extending transversely to the longitudinal center axis 15 of the housing 11, and in terms of the shape of the grip it is formed as a bow-shaped handle, which extends past the rear end of the housing 11 and there forms a reach-through opening 16. A conventional additional handle 17 can be detachably mounted on the housing 11. The hand-operated power tool 10 with this kind of handle assembly 20 is especially well suited to vertical operation, in which the handle assembly 20 makes good manipulation and in particular good grasping and steering, of the hand-operated power tool 10 possible in vertical operation with an approximately vertically extending longitudinal center axis 15.

Figure 3:
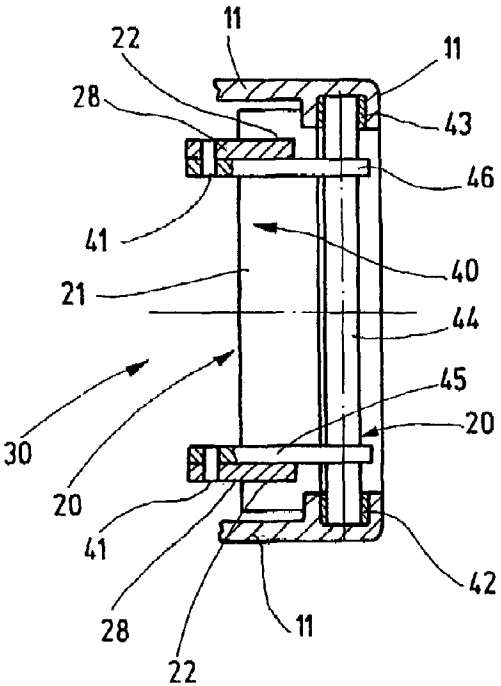
FIG. 3 is a schematic section taken along the line III-III in FIG. 2.

The special feature of the hand-operated power tool 10 is that the handle assembly 20, relative to the housing 11 with the components not shown contained in it, is vibration-damped at least and essentially in the axial direction. Inside the housing 11, between it and the handle assembly 20, there is a vibration-damping device 30 for vibration damping, the details of which will be described in further detail hereinafter in conjunction with FIGS. 2 through 4. The vibration-damping device 30 has at least one damping element 31, for instance in the form of a spring, and in particular a cylindrical helical spring, which is braced on one end on the handle assembly 20 and on the housing 11 and effects vibration damping of the handle assembly 20 with respect to the housing 11 by means of relative elastic inward/outward yielding.

The handle assembly 20 has at least one substantially longitudinally oriented guide rod 22, whose end protruding from the housing 11 is engaged by the handle 21. Depending on the particular design of the handle assembly 20, one guide rod 22 may suffice. In the exemplary embodiment shown, conversely, the handle assembly 20 has two guide rods 22, spaced apart from one another and extending parallel to one another, which are preferably also designed identically. For the sake of simplicity, further details will therefore be given taking one guide rod 22 as an example. The guide rod 22 is approximately rectangular in cross section and is thus designed as a substantially flat strut. Instead, the guide rod 22 may be circular or some other shape in cross section. Beginning at the handle 21, the guide rod 22 protrudes with a lengthwise portion 23 into the rear portion 14 of the housing 11. With its end portion 24 located in the interior of the housing 11 and facing away from the handle 21, the respective guide rod 22 is movably received and guided inside a receptacle 32 of the housing 11. This receptacle 32 toward the housing for the end portion 24 is embodied as a slot 33, extending approximately parallel to the longitudinal center axis 15 and transversely to the length of the handle 21; the slot is oriented at right angles to the plane of the drawing in FIG. 2, and it has two correspondingly oriented flat guide faces 34 and 35 extending spaced apart and side by side. The at least one guide rod 22, with its end portion 24, engages the inside of this associated slot 33 with play of motion and is held and guided in form-locking fashion in the slot, between the two flat guide faces 34 and 35, with flat faces 25, 26 on both sides. In the penetration direction of the end portion 24 of the guide rod 22, the receptacle 32 has a correspondingly great depth, which permits a substantial penetration of the end portion 24 upon inward yielding, approximately in the direction of the longitudinal center axis 15. Upon outward yielding of the handle assembly 20, the end portion 24 of the respective guide rod 22 assumes the position of repose shown in FIGS. 2 and 4. This engagement position between the end portion 24 and the slot 33 is preserved even whenever the handle assembly 20 is moved, from the position shown in FIGS. 2 and 4, in a direction facing away from the tool receptacle 13, or in other words to the right in terms of FIGS. 2 and 4, relative to the housing 11. This outward-yielding travel of the at least one guide rod 22 is limited by stops, for instance by one stop 36 toward the housing and one stop 27 of the guide rod 22.

Figure 2:
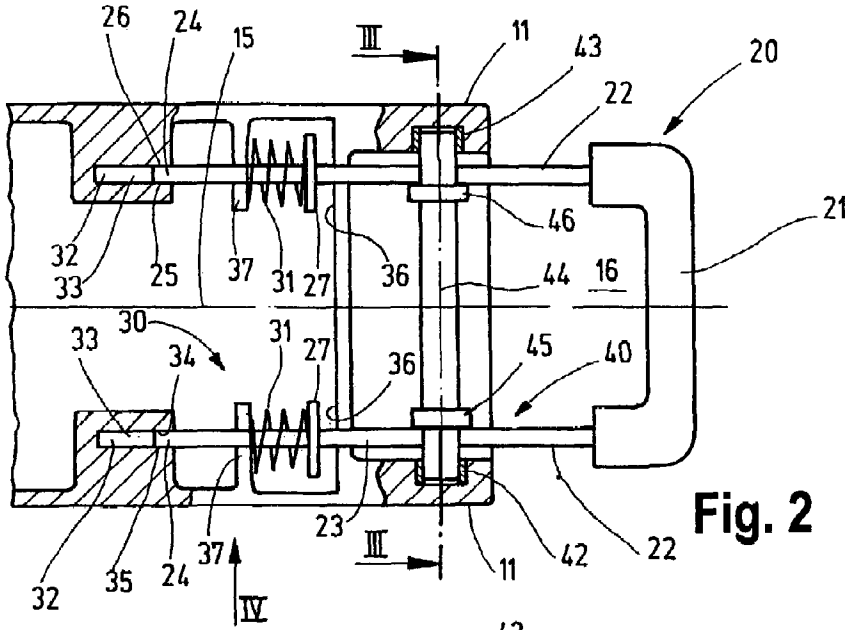
FIG. 2 is a schematic sectional view with a partial side view of a rear region of the hand-operated power tool of FIG. 1, on a larger scale.

Each receptacle 32, and in particular each slot 33, is larger, viewed approximately at right angles to the plane of the drawing of FIG. 2, or in other words transversely to the penetration depth and along the flat guide faces 34 and 35, than the width of the end portion 24, extending in this direction, of the at least guide rod 22. It is thus assured that upon inward/outward yielding of the handle assembly 20, enough room remains inside the receptacle 32 for the end portion 24 of the respective guide rod 22.

The vibration-damping device 30, and in particular the at least one damping element 31 per guide rod 22, is located on the guide rod 22 and is braced on one side on the stop 27 of the guide rod 22 and by its other end toward the housing, for instance on a stop 37 there. This stop 37 also serves to limit the inward-yielding travel of the damping element 31, which after traversing the maximum inward-yielding travel is for instance compressed to a block.

Figure 4:
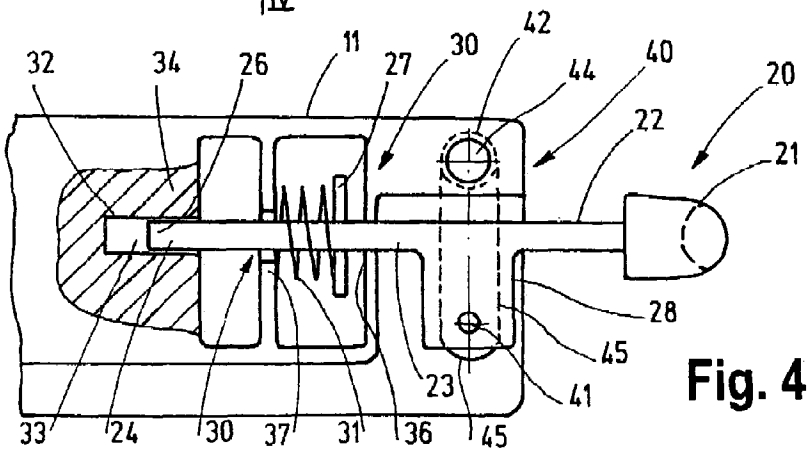
FIG. 4 is a schematic side view, partly in section, in the direction of the arrow IV in FIG. 2.

Another essential component of the vibration-damping device 30 is a pivot mount 40, located in the housing 11, for the handle assembly 20. This pivot mount 40 is embodied approximately like a rocker, on which the handle assembly 20 and in particular the at least one guide rod 22 is pivotably movably held about a pivot shaft 41. The pivot shaft 41 extends transversely to the longitudinal center axis 15 and approximately parallel to the handle 21. The pivot mount 40 has a shaft 44, pivotably held on both ends in the housing 11, for instance by means of bearings 42, 43 shown in suggested fashion, and on which shaft one lever 45, 46 per guide rod 22 is mounted fixedly and nonrotatably. Spaced apart from the shaft 44, one guide rod 22 is pivotably connected to the respective lever 45, 46 about the pivot shaft 41, for instance by means of a bolt held on the lever 45, 46. The pivot shaft 41 of each guide rod 22 extends with transverse spacing from and below the shaft 44. Each guide rod 22 has one arm 28, projecting transversely from it, which as shown in FIG. 4 is oriented downward and in the region of which the pivotably movable mounting on the respective lever 45, 46 is effected and in which region the pivot shaft 41 extends.

The handle assembly 20, in its design as a bow-shaped handle, makes good handling and in particular good gripping and steering, of the hand-operated power tool 10 possible. The vibration-damping device 30 is simple and inexpensive and requires only little structural volume. As the hand-operated power tool 10 is being handled, it makes cushioning of the complete handle assembly 20 possible. Since there is no rigid connection between the handle assembly and the rest of the hand-operated power tool, a relative damping is assured during operation between the handle assembly 20 and the hand-operated power tool 10, and in particular an inward yielding of the handle assembly 20; because the respective end portion 24 of each guide rod 22 is received in form-locking fashion in the receptacle 32, relative motion between the handle assembly 20 and the rest of the hand-operated power tool 10 is avoided. Nor is there any risk of any tilting motion. The inward yielding of the handle assembly 20 is effected regardless of how the user is handling the hand-operated power tool. Since the vibration-damping device 30 is located inside the housing 11, the vibration-damping device with all its components, and in particular the pivot mount 40, is protected against external mechanical impairments, against soiling or the like. Thus the vibration-damping device 30 is highly safe and reliable in operation. In the handling of the hand-operated power tool 10, the hand-operated power tool is grasped by the user in the rear region of the handle assembly 20, on the handle 21, and if necessary also on the additional handle 17. If the user exerts pressure in the direction of the tool receptacle 13 via the handle assembly 20, for instance in the direction of the longitudinal center axis 15, or if a contrary motion to it is effected relative to the handle assembly 20 by the rest of the hand-operated power tool 10, then any vibration is absorbed and at least damped by the vibration-damping device 30. Each guide rod 22 pivots in such a way that upon inward yielding in the direction of the tool receptacle 13, pivoting is effected in the direction of the pivot shaft 41 and hence pivoting of the levers 45, 46, which are fixed to the shaft 44, together with the shaft 44 about its axis. Hence the pivot shaft 41 moves along a circular arc whose center is the center of the shaft 44. In the process, the end portion 24 of each guide rod 22 moves more deeply into the associated receptacle 32 and simultaneously, upon inward cushioning in FIG. 4 inside the receptacle 32, moves upward. The at least one damping element 31, in particular the spring, dampingly absorbs the relative vibration between the handle assembly 20 and the rest of the hand-operated power tool 10. Thus a vibration reduction for the hand-operated power tool 10 is attained in a simple way, and this is achieved at little expense and with only a small required structural volume.

In the exemplary embodiment shown, each guide rod 22 has at least one damping element 31, in particular a spring, and at least one end portion 24, which is received in an associated receptacle 32 of the housing 11. In another exemplary embodiment, not shown, only one such guide rod 22 is provided, which in turn is provided with at least one damping element 31 and with the end portion 24 on the end; on the housing, a corresponding receptacle 32 is associated with the end portion 24.

In another exemplary embodiment, not shown, although two guide rods 22 are provided as in the exemplary embodiment shown, one of the guide rods extends only as far as the arm 28 and the pivot shaft 41 and ends next to it, omitting out an end portion 24 that engages an associated receptacle 32 and leaving out at least one damping element 31. The handle assembly 20 even then is received by means of the pivot mount 40 in approximately rocker like fashion, so that even with unilateral damping and reception of an end portion 24 in a receptacle 32, equally good manipulation of the hand-operated power tool 10 is possible, since the handle assembly is still connected to the rocker like pivot mount 40 in the region of both longitudinal portions 23 and is held in a manner fixed against relative rotation in the direction of the respective pivot shaft 41.

The invention claimed is:

1. A hand-operated power tool, comprising a housing with a drive mechanism for driving a tool; a tool receptacle for receiving a tool; a handle assembly for grasping and handling, said handle assembly being located in a rear region which is remote from said tool receptacle and engaging said housing, said handle assembly being vibration-damped with respect to said housing with components contained in said housing, at least in an axial direction said handle assembly having a handle; and a pivot mount located in said housing, said handle assembly being pivotally movably held on said pivot mount about a pivot shaft extending transversely to a longitudinal center axis and substantially parallel to said handle, said handle assembly having two guide rods that are spaced from one another, said pivot mount having a shaft extending transversely to the longitudinal center axis and pivotally held in said housing, and has one lever per each of said guide rods, said lever being fixedly mounted on said shaft, and a respective one of said guide rods is held pivotally on a respective one of said levers movably about said pivot shaft.

2. A hand-operated power tool as defined in claim 1; and further comprising a vibration-damping device located inside said housing between said housing and said handle assembly and having at least one damping element which is braced on one side on said handle assembly and on another side on said housing and effects vibration damping of said handle assembly relative to said housing by elastically inwardly/outwardly yielding.

3. A hand-operated power tool as defined in claim 2, wherein said at least one damping element of said vibration-damping device is configured as a spring.

4. A hand-operated power tool as defined in claim 2, wherein said handle assembly has at least one longitudinally oriented guide rod and a handle engaged in one end of said guide rod, said guide rod traveling in opposite directions, and a travel of said guide rod is limited by stops.

5. A hand-operated power tool as defined in claim 1, wherein said handle assembly has at least one substantially longitudinally oriented guide rod and a handle engaging one end of said guide rod, said guide rod having a longitudinal portion engaging an inside of said housing and a portion facing away from said handle and movably received and guided inside a receptacle of said housing.

6. A hand-operated power tool as defined in claim 5, wherein said vibration-damping device has at least one damping element located on said guide rod and braced on one side on a stop of said guide rod and on another side on a stop structurally connected to said housing.

7. A hand-operated power tool as defined in claim 5, wherein said receptacle of said housing in which said end portion of said rod is received and guided is configured as a slot extending substantially parallel to a longitudinal center axis and transversely to a length of said handle, said guide rod with said end portion engaging an inside of said slot with play of motion and having flat sides which are guided in form-locking fashion between two adjacent flat guide faces of said slot.

8. A hand-operated power tool as defined in claim 5, wherein said receptacle of said housing in which said guide rod is movably received and guided, as viewed transversely to a penetration depth and along flat guide faces of said guide rod, is larger than a width of said end portion of said guide rod.

9. A hand-operated power tool as defined in claim 5, wherein said rod has at least one damping element and an end portion that is received in an associated receptacle of said housing.

10. A hand-operated power tool as defined in claim 1, wherein said handle assembly has two guide rods which are spaced apart from one another and extend substantially parallel to one another.

11. A hand-operated power tool as defined in claim 10, wherein said guide rods protrude out of said rear region of said housing and are joined together via a handle that extends transversely to said guide rods and is configured as a bow-shaped handle.

12. A hand-operated power tool as defined in claim 10, wherein each of said guide rods has at least one damping element that is received in an associated receptacle of said housing.

13. A hand-operated power tool as defined in claim 1, wherein said pivot shaft with a respective one of said guide rods extends in a transverse spacing from said shaft.

14. A hand-operated power tool as defined in claim 1, wherein each of said guide rods has an arm projecting transversely away from a respective of said guide rods, so that in a region of said arm a pivotally movable mounting is provided on a respective one of said levers and said pivot shaft extends.

15. A hand-operated power tool as defined in claim 1, wherein the hand-operated power tool is configured as a power tool selected from the consisting of a drill hammer, a jackhammer, and a drill/jackhammer.

* * * * *